US006311659B1

(12) United States Patent
Pierik

(10) Patent No.: US 6,311,659 B1
(45) Date of Patent: Nov. 6, 2001

(54) DESMODROMIC CAM DRIVEN VARIABLE VALVE TIMING MECHANISM

(75) Inventor: Ronald Jay Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/482,798

(22) Filed: Jan. 13, 2000

Related U.S. Application Data

(60) Provisional application No. 60/136,923, filed on Jun. 1, 1999.

(51) Int. Cl.[7] ..... F01L 1/30

(52) U.S. Cl. ..... 123/90.24; 123/90.15; 123/90.16; 123/90.17; 123/90.25

(58) Field of Search ..... 123/90.16, 90.17, 123/90.24, 90.25

(56) References Cited

U.S. PATENT DOCUMENTS 1,671,973 * 6/1928 Anderson ..... 123/90.25
1,740,790 * 12/1929 Stanton ..... 123/90.25
4,364,341 * 12/1982 Holtmann ..... 123/90.17
5,988,125 * 11/1999 Hara et al. ..... 123/90.16

* cited by examiner

*Primary Examiner*—Thomas Denion
*Assistant Examiner*—Jaime Corrigan
(74) *Attorney, Agent, or Firm*—John A. Vanophen

(57) ABSTRACT

A desmodromic cam driven variable valve timing (VVT) mechanism includes dual rotary opening and closing cams for actuating a rocker mechanism that drives valve actuating oscillating cams. The dual rotary cam drive positively actuates the rocker mechanism in both valve opening and valve closing directions and thus avoids the need to provide return springs as required in prior cam driven mechanisms to bias the mechanisms toward a valve closed position. A variable ratio slide and slot control lever drive as well as a back force limiting worm drive for the control shaft are combined with the desmodromic cam mechanism to provide additional system advantages.

15 Claims, 8 Drawing Sheets

DESMODROMIC CAM DRIVEN VARIABLE VALVE TIMING MECHANISM

CROSS REFERENCE TO RELATED APPLICATIONS

This application claims the benefit of U.S. Provisional Application No. 60/136,923, filed Jun. 1, 1999.

TECHNICAL FIELD

The invention relates to variable valve timing mechanisms and, more particularly, to valve actuating mechanisms for varying the lift and timing of engine valves.

BACKGROUND OF THE INVENTION

U.S. Pat. No. 5,937,809, issued Aug. 17, 1999, discloses cam driven variable valve timing (VVT) mechanisms which are relatively compact, and are applicable for operating individual or multiple valves. In these mechanisms, an engine valve is driven by an oscillating rocker cam that is actuated by a linkage driven by a rotary eccentric, preferably a rotary cam. The linkage is pivoted on a control member that is, in turn, pivotably about the axis of the rotary cam and angularly adjustable to vary the orientation of the rocker cam and thereby vary the valve lift and timing. The rotary cam may be carried on a cams haft. The oscillating cam is pivoted on the rotational axis of the rotary cam.

U.S. patent application Ser. No. 09/129,270, filed Aug. 5, 1998, discloses a similar cam actuated VVT mechanism having various additional features, including a variable ratio pin and slot control member drive providing advantageous control characteristics and a worm drive for the control shaft designed to prevent backdrive forces from overcoming the actuating force of the small drive motor. A particular embodiment of flat spiral mechanism return springs is also disclosed.

SUMMARY OF THE INVENTION

The present invention provides improved VVT mechanisms wherein dual desmodromic rotating cams are provided for actuating oscillating cam drive mechanisms. The dual rotating cam drive includes both opening and closing cams that actuate the mechanisms in both valve opening and valve closing directions. The desmodromic cams thus avoid the need to provide return springs which are required in previous cam driven VVT mechanisms to bias the mechanisms toward a valve closed position. The dual cams may be located at axially adjacent positions on a single cams haft. A single rocker with dual arms may carry separate followers, one engaging each cam to provide the positive opening and closing action needed to eliminate mechanism return springs without requiring extended motion of the oscillating cams as in a crank driven mechanism.

A mechanism lash adjuster or a semi-compliant return follower arm may be used to take up lash between the dual cam followers of the rotary cams.

The advantages of control by a variable ratio slide and slot control lever drive as well as a back force limiting worm drive for the control shaft may be combined with the dual cam mechanism to provide additional system advantages comparable to those designed for single cam actuated mechanisms requiring return springs.

These and other features and advantages of the invention will be more fully understood from the following description of certain specific embodiments of the invention taken together with the accompanying drawings.

DESCRIPTION OF THE PREFERRED EMBODIMENT

Figure 1:
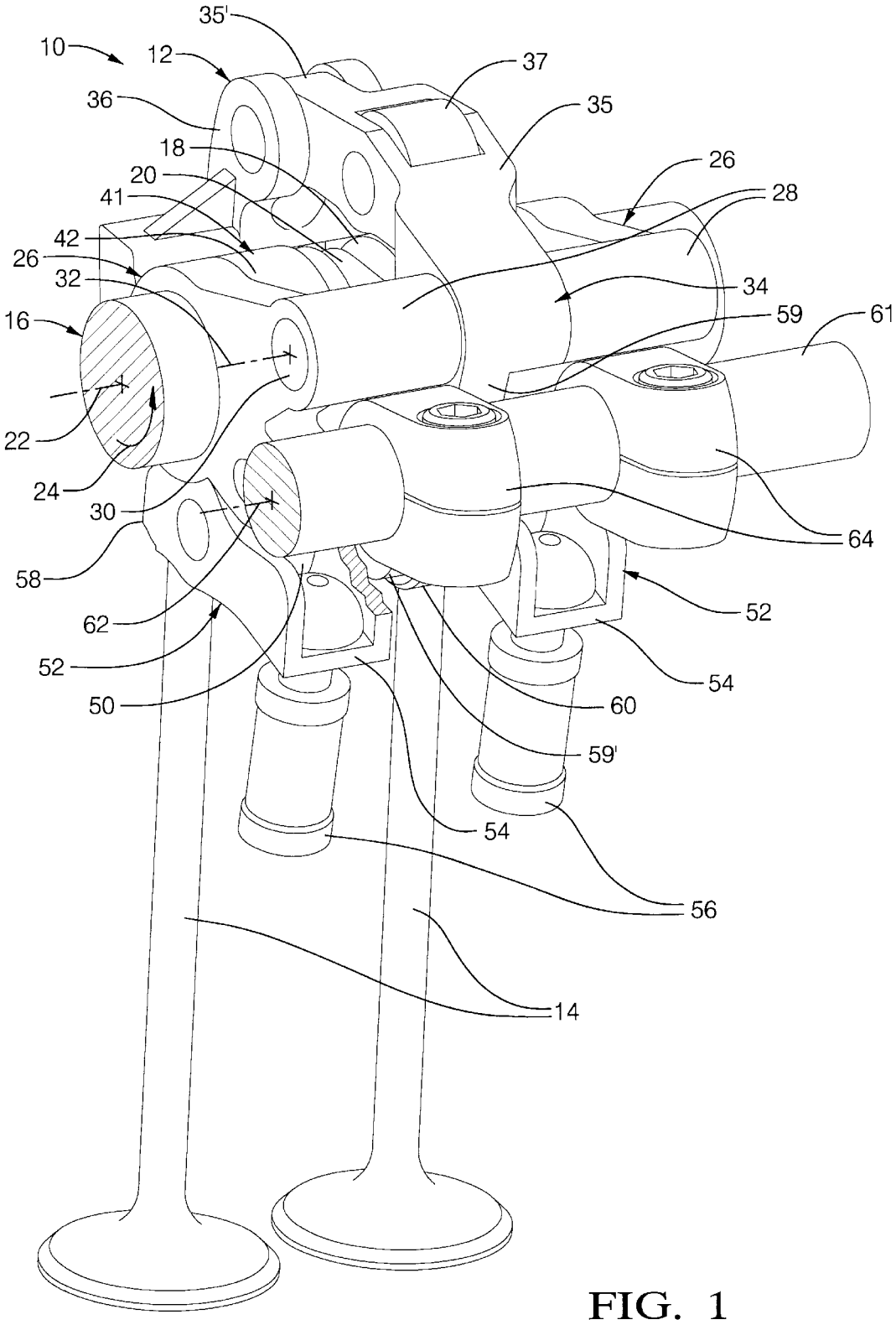
FIG. 1 is a pictorial view of a first embodiment of desmodromic cam VVT mechanism for dual valves of a single engine cylinder.
Figure 2:
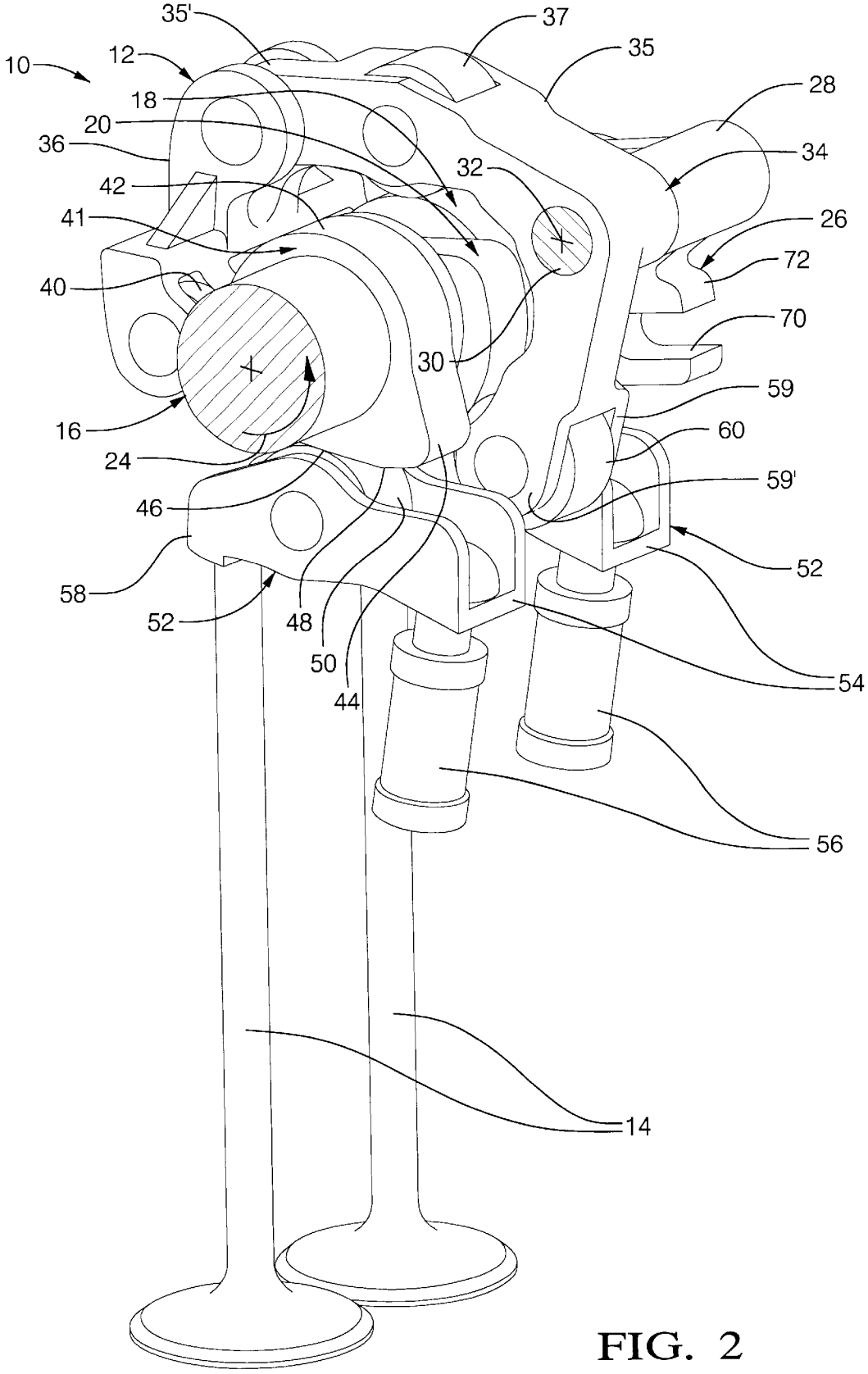
FIG. 2 is a view similar to FIG. 1 but having portions of the mechanism omitted for clarity.
Figure 3:
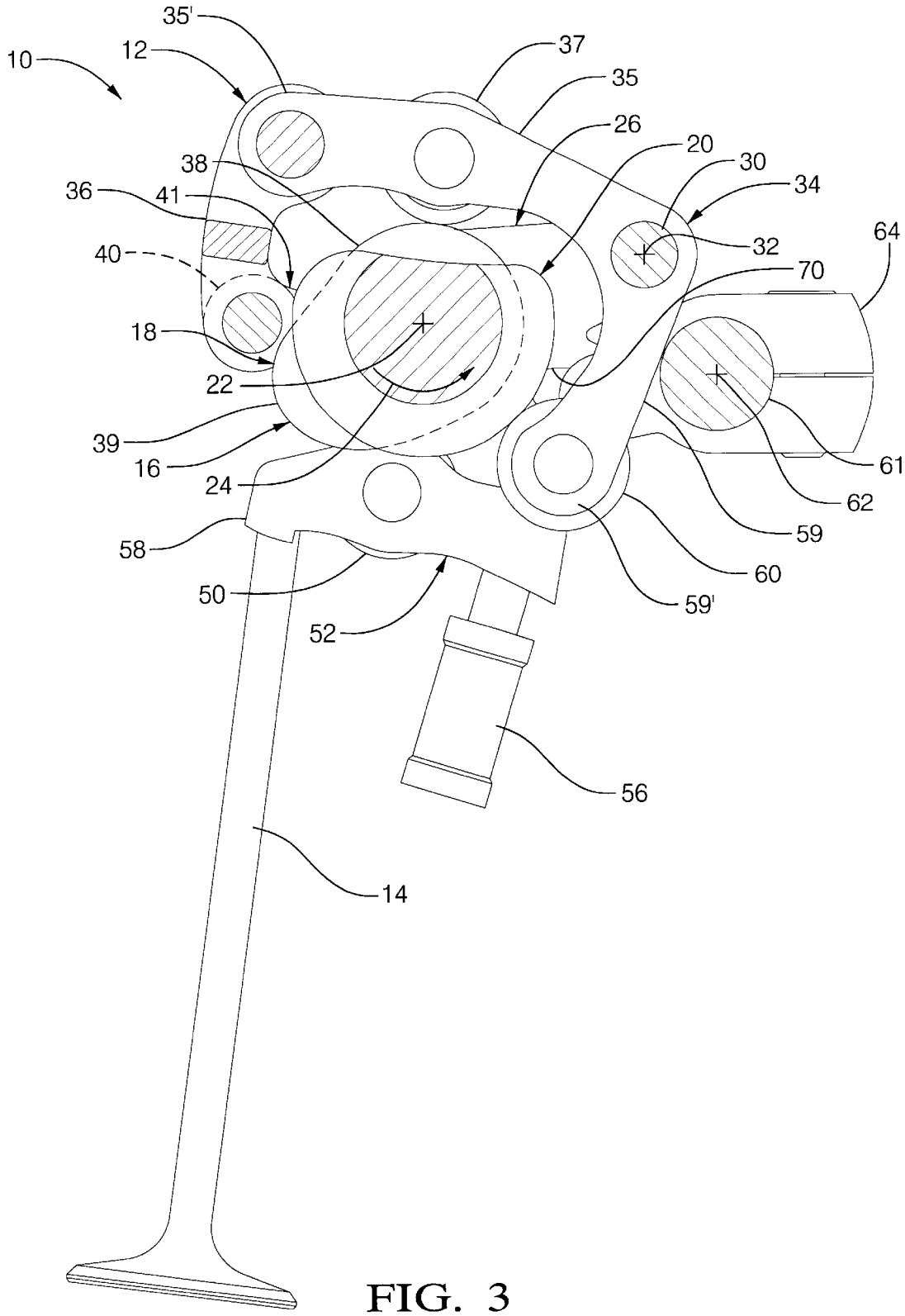
FIG. 3 is a transverse cross-sectional view of the embodiment of FIG. 1 taken from the near side of the desmodromic cams.

Referring first to FIGS. 1–5 of the drawings, numeral 10 generally indicates a portion of an internal combustion engine including a valve actuating mechanism 12 operative to actuate dual indict valves 14 for a single cylinder of an engine. Mechanism 12 includes a rotary camshaft 16 that extends the length of a cylinder head, not shown, of a multi-cylinder engine, of which the mechanism for only a single cylinder is illustrated. The camshaft 16 may be driven from the engine crankshaft by a chain or any other suitable means.

Camshaft 16 includes a pair of mechanism actuating cams including a valve opening cam 18 and a valve closing cam 20 spaced axially adjacent one another along a primary axis 22 of the camshaft 16. Rotation of the crankshaft 16 is optionally counterclockwise as shown by the arrow 24 but an opposite rotation could be used if desired.

Control members (or frames) 26 are mounted on the camshaft 16 for pivotal motion about the primary axis 22. If desired, the control members could be mounted other than on the camshaft. The nearer one of the dual control members is omitted from FIG. 2 for clarity. The control members 26 each include an outer end 28 connected with a pivot pin 30 disposed on a first pivot axis 32. A rocker 34 is pivotally mounted to the pivot pin 30 which connects it with the control members 26. A first rocker arm 35 of the rocker 34 extends from a first end at the pivot pin 30 to a distal end 35' pivotally connected by a pin to a link 36. Between its ends, rocker arm 35 carries a follower roller 37 which engages the valve opening cam 18. As pictured, the roller 37 is shown riding on the base circle 38 of the opening cam 18 instead of the valve lift portion 39 as will be subsequently discussed.

Link 36 extends from the rocker lever 34 to outer ends 40 of a pair of actuating levers 41 to which the link 36 is pinned. Levers 41 have inner ends 42 which are mounted on the camshaft 16 and pivotable about the primary axis 22. These inner ends define oscillating cam is 44, each having a base circle portion 46 and a valve lift portion 48. The base circle and valve lift portions are similar to those discussed in the previously mentioned U.S. Pat. No. 5,937,809, which may be consulted for additional details of their appearance and operation.

The oscillating cams 44 are engaged by rollers 50 of roller finger followers 52, each having inner ends 54 which are pivotally seated on stationary hydraulic lash adjusters 56 mounted in the engine cylinder head, not shown. Outer ends 58 of the finger followers 52 engage the stems of valves 14 for directly actuating the valves in cyclic variable lift opening patterns as controlled by the mechanism. Valve springs, not shown, are conventionally provided for biasing the valves in a closing direction.

To provide for positive return motion of the mechanism 12 including the oscillating cams 44, rocker 34 includes a second rocker arm 59, extending from a first end at the rocker pivot 30 to a second end 59' carrying a second follower roller 60. Roller 60 engages the valve closing cam 20 to positively return the mechanism 12 to the valve closed condition as the valve opening cam 18 rotates away from the peak of the valve lift portion of the cam. Cams 18 and 20 thus cooperate to provide desmodromic valve action through positive opening and closing motion of the actuating mechanism 12. This avoids the need for return springs (other than the valve springs, not shown) to return the mechanism 12 to the valve closed condition.

Figure 4:
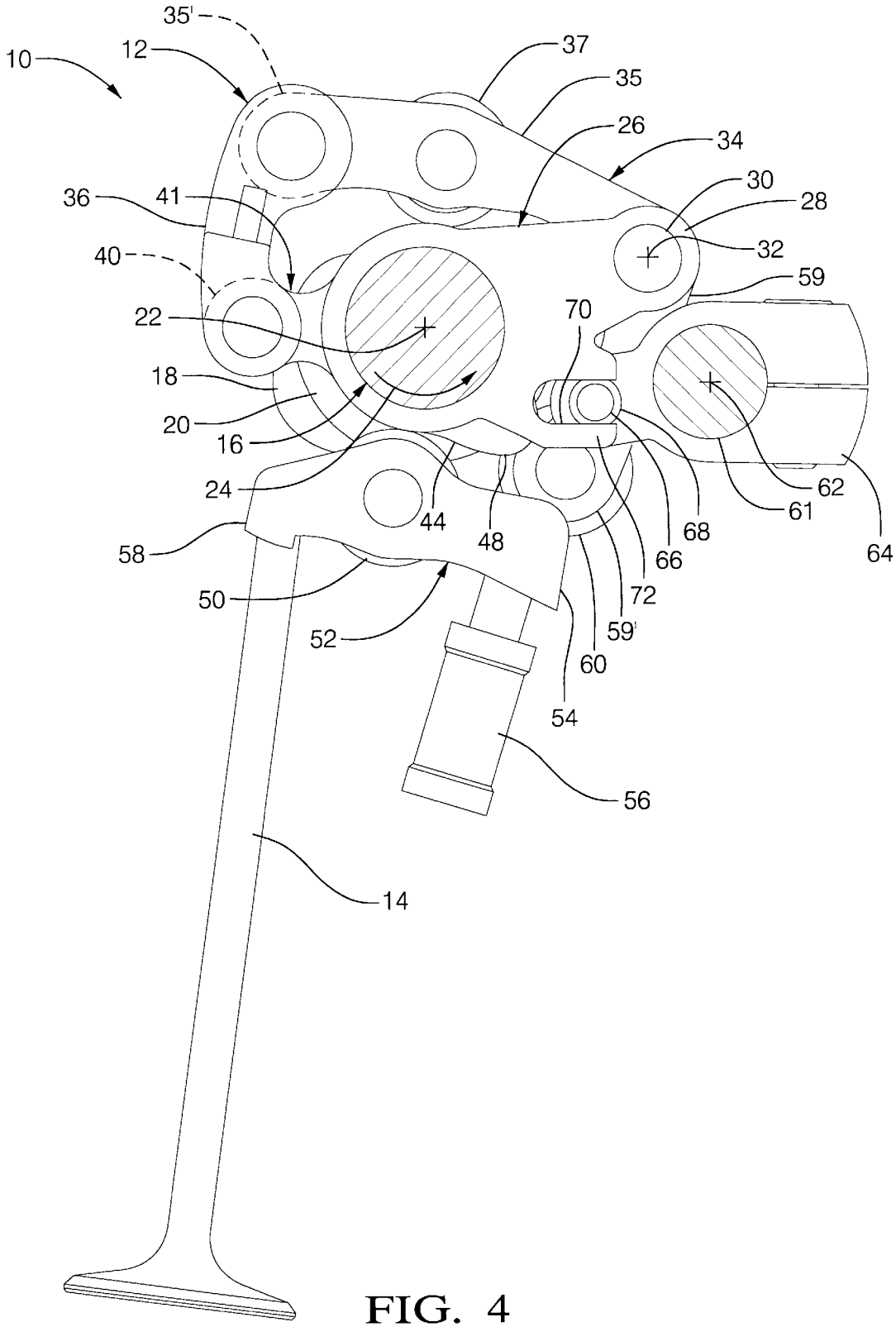
FIG. 4 is a cross-sectional view showing a pin and slot control in a maximum valve lift position.
Figure 5:
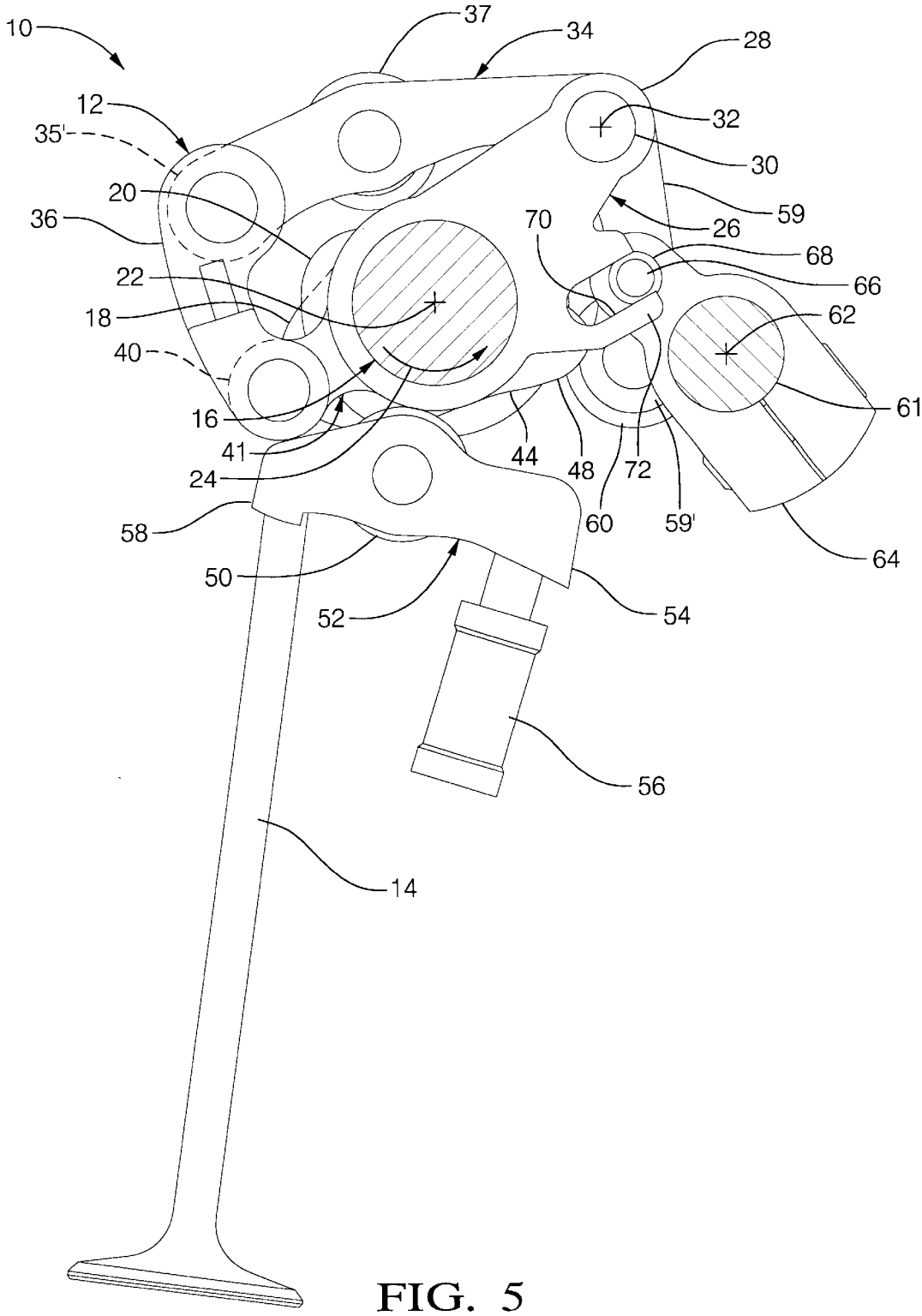
FIG. 5 is a view similar to FIG. 4 but showing the minimum valve lift position.

In order to provide the variable valve lift and timing which are results of the mechanism, a control shaft 61 (omitted from FIG. 2) is provided that is pivotable about a secondary axis 62 parallel with and spaced from the primary axis 22. If desired, the control shaft 61 could be connected to the control members 26 by a gear tooth connection as shown in previously mentioned U.S. Pat. No. 5,937,809 to vary the mechanism between maximum and minimum11 valve lift positions. However, in the present embodiments, a preferred pin and slot connection is used as shown in FIGS. 4 and 5. FIG. 4 shows the control members 26 in the maximum valve lift position, while FIG. 5 shows the control members 26 in the minimum valve lift position. The control shaft 61 mounts a pair of control levers 64. Each of the control levers mounts a drive pin 66 which preferably caries a flat sided bushing 68. Each bushing 68 acts as a slider and is slidable within a slot 70 provided in an arm 72 of an associated one of the frame elements or control members 26. The slots 70 of the arms are angled with respect to a radius from the primary axis 22 in order to provide a variation in ratio of the movement between the control shaft 61 and the control member 26, as will be subsequently more fully described.

In operation of the mechanism so far described, rotation of the valve actuating camshaft 16 rotates the desmodromic cams 18, 20 in phase with the engine crankshaft, not shown. Thus, the cams 18, 20 oscillate the rocker 34 around its pivot pin 30 with a cyclic angular oscillation that is a constant function of engine crank rotation, except for variations in valve timing. As the rocker arm 35 is pivoted outward away from the primary axis 22, it draws the link 36 with it, in turn oscillating the actuating levers 41 and associated oscillating cams 44 through a predetermined constant angle with each rotation of the camshaft.

FIG. 4 illustrates the position of the mechanism 12 with the control member 26 pivoted clockwise to the full valve lift position. In this position, pivoting of the oscillating cams 44 by the mechanism forces the finger followers 52 downward as the oscillating cams move from their base circle locations clockwise until the nose of each cam 44 is engaging its associated follower roller 50 in the full valve lift position. This causes the finger follower to pivot downward, forcing its valve 14 into a fully open position.

As the cams 18, 20 rotate further from the full open position of the valves, the mechanism rotates the oscillating cams 44 counterclockwise, returning the finger follower rollers 50 to the base circles of the oscillating cams and thereby allowing the valves 14 to be closed by their valve springs, not shown. A useful advantage of the present desmodromic cam actuated mechanism over prior cam actuated VVT mechanisms is that the mechanism cycle is completed without requiring mechanism return springs. Instead, the opening and closing cams 18, 20 positively move the mechanism in both directions of oscillation, avoiding the need for springs other than the usual valve springs.

To reduce valve lift and at the same time advance the timing of peak valve lift, the control shaft 60 is rotated clockwise to the position shown in FIG. 5 where the control member 26 is rotated fully counterclockwise. In this minimum valve lift position of the control shaft 60, actuation of the rocker lever 34 by the rotary crank 18 is prevented from opening the valves more than a preset minimum because the finger follower rollers 50 are in contact primarily or only with the base circle portions 46 of the oscillating cams. To accomplish this, the angular movement of the control member 26 from its full lift position of FIG. 4, must approximate the angular displacement of the oscillating cams during the valve lift portion of the stroke of the rocker lever caused by the rotary cams so that the finger follower rollers never, or only slightly, contact the valve lift portion 48 of the oscillating cams.

The position of the mechanism 10 about the primary axis 22 is determined by rotation of the control shaft 60 as previously described. Since the engine charge mass flow rate has a greater relative change in low valve lifts than in high valve lifts, the slider and slot connection between each control lever 64 and its control member 26 is designed so that the angled slot provides a variable angular ratio such that, at low lifts, the control shaft must rotate through a large angle for small rotation of the control member. This is accomplished by positioning the angle of the slot relative to a radial line from the primary axis 22 in order to obtain the desired change in angular ratio. With appropriate design, the ratio may be varied from about 5:1 at low lifts with a relatively rapid change toward middle and high lift positions to a ratio of about 2:1. The result is advantageous effective control of gas flow through the inlet valves over the whole range of valve lifts.

Because of the requirement of periodic valve opening and valve spring compression of each cylinder, the control shaft in a multi-cylinder engine is required to operate against cyclically reversing torques applied against the control members or frames. If the actuator was required to change the mechanism position during all of the control shaft torque values, including peak values, the actuator would need to be relatively large and expensive and consume excessive power to obtain a reasonable response time.

Figure 6:
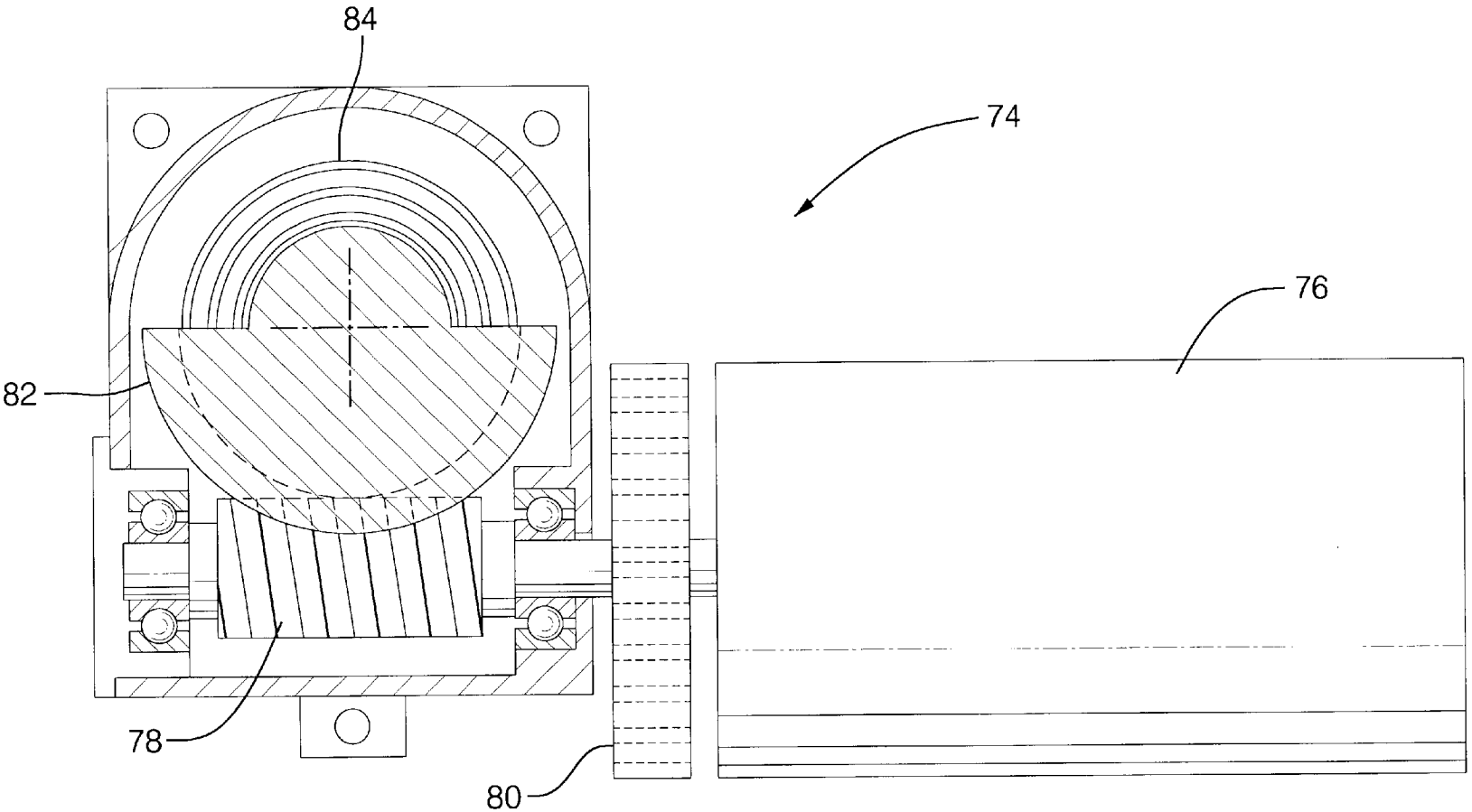
FIG. 6 is a cross-sectional view of a worm drive for actuating the control shaft of the mechanism.

To avoid this, FIG. 6 illustrates a worm gear actuator 74 applied for driving the control shaft 60 to its various angular positions. Actuator 74 includes a small electric drive motor 76 driving a worm 78 through a shaft that may be connected with a spiral return spring 80. The worm 78 engages a worm gear 82 formed as a semi-circular quadrant. The worm gear is directly attached to an end, not shown, of a control shaft 60 for rotating the control shaft through its full angular motion. The pressure and lead angles of the teeth of the worm and the associated worm gear are selected as a function of the friction of the worm and the worm gear, so that back forces acting from the worm gear against the worm will lock the gears against motion until the back forces are reduced to a level that the drive motor 76 is able to overcome.

Thus, in operation, when a change in position of the mechanism control member is desired, drive motor 76 is operated to rotate the worm 78 and the associated worm gear 82 in the desired direction. A spiral torque biasing spring 84 is applied to the worm gear 82 (or the control shaft 74) to bias the drive forces so as to balance the positive and negative control shaft torque peaks so that the actuator is subjected to equal positive and negative torques. The biasing spring 84 will thus balance the system time response in both directions of actuation.

When the torque peaks are too high in the direction against the rotation of the motor, the worm drive will lock up, stalling the motor until the momentary torques are reduced and the motor again drives the mechanism in the desired direction with the assistance of torque reversals acting in the desired direction. The result is that a relatively low powered motor is able to provide the desired driving action of the control shaft and actuate the mechanisms with a relatively efficient expenditure of power. If used, the return spring 80 is installed so as to cause the actuation system to default to a low lift position during engine shutdown.

Figure 7:
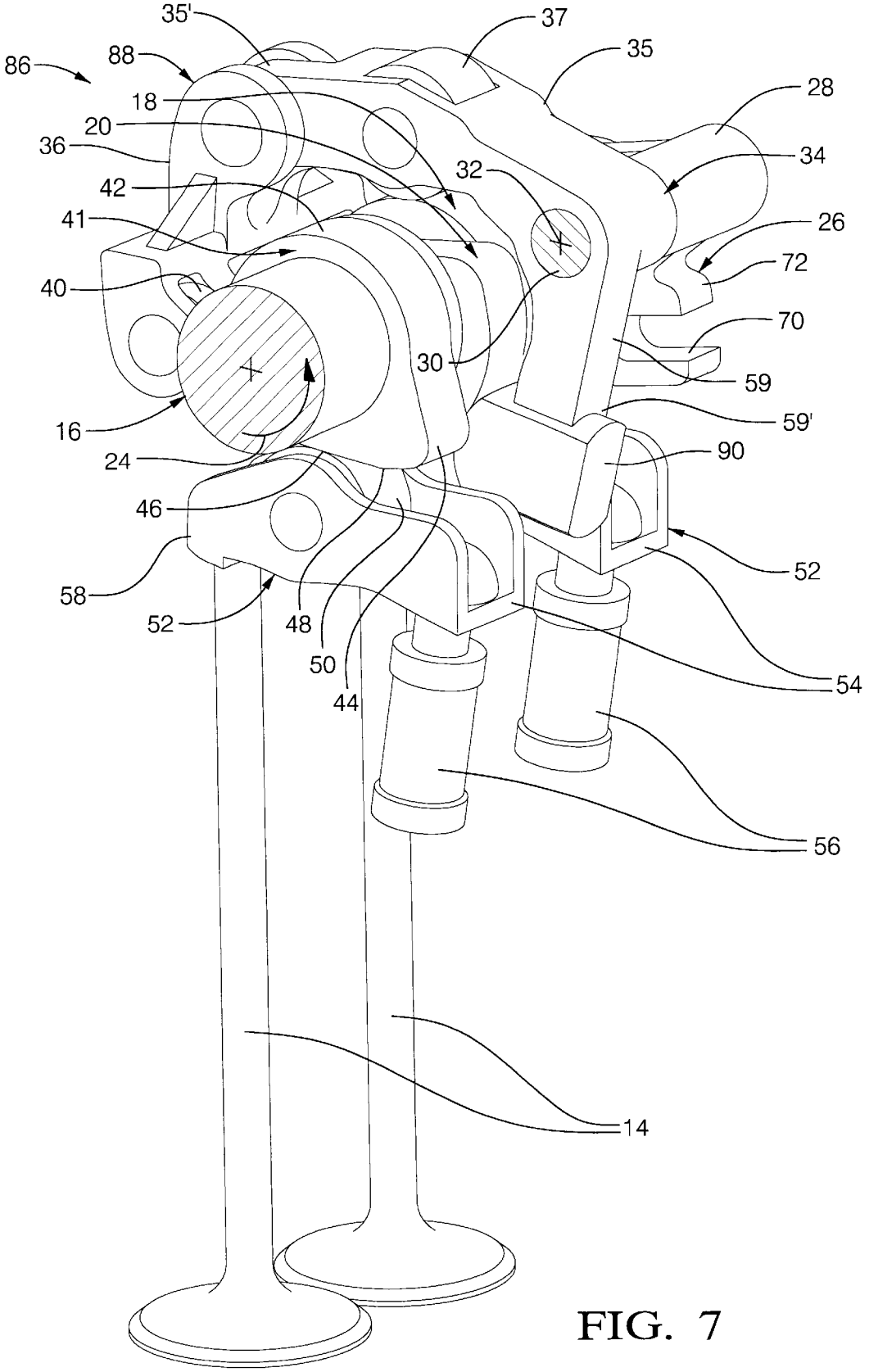
FIG. 7 is a pictorial view similar to FIG. 2 but showing an alternative embodiment including a hydraulic or mechanical lash adjuster.
Figure 8:
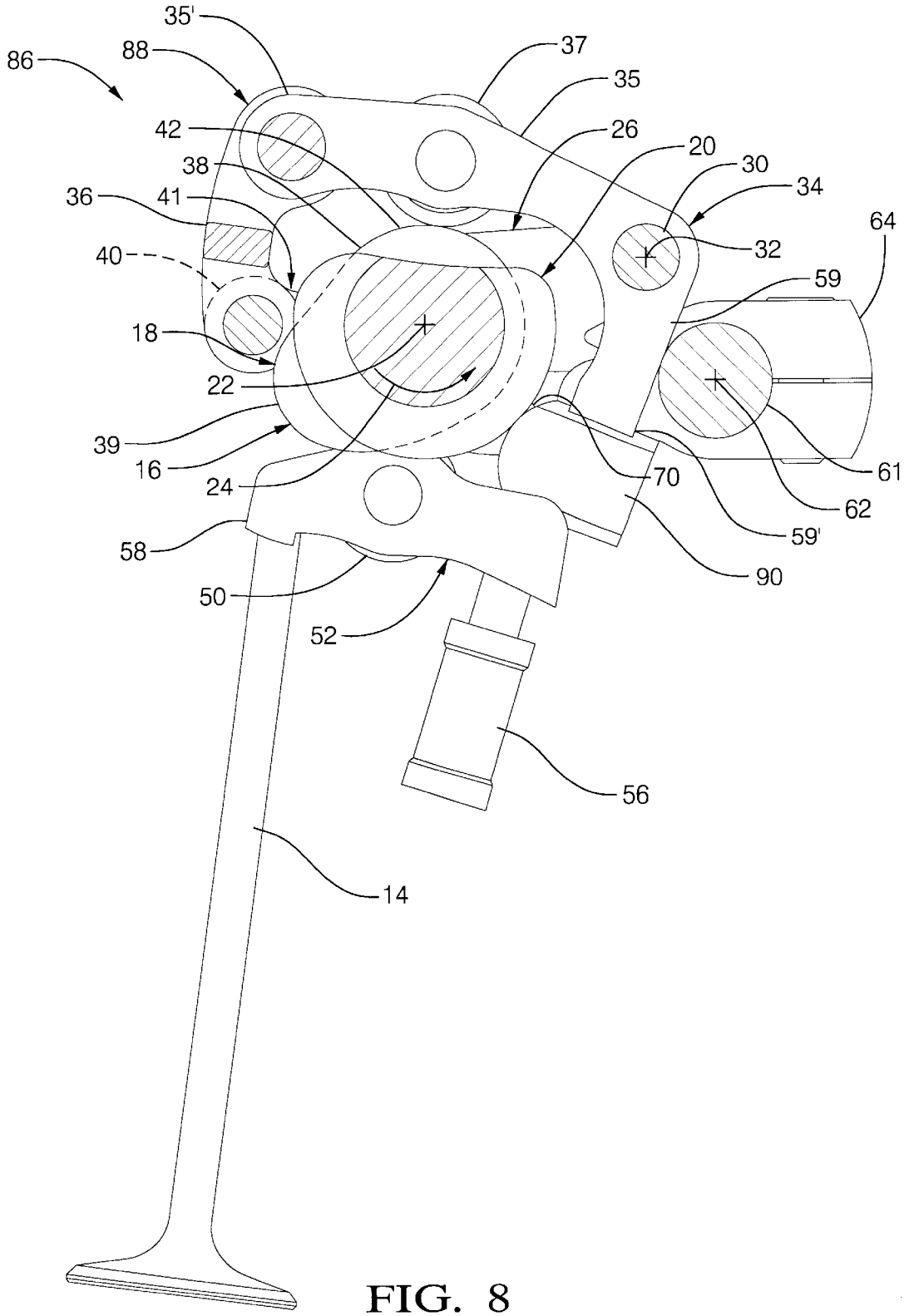
FIG. 8 is a view similar to FIG. 3 but showing the embodiment of FIG. 7.

Referring now to FIGS. 7 and 8, there is shown an engine 86 with an alternative embodiment of valve actuating mechanism 88 similar in most respects to the embodiment of FIGS. 1–5 and wherein like numerals indicate like parts. The embodiment of FIGS. 7 and 8 differs from that of the first embodiment primarily in the provision of a hydraulic or mechanical lash adjuster and sliding closing cam follower 90 in place of the follower roller 60 of the first embodiment. This mechanism lash adjuster functions to take up any lash in the mechanism 88 due to manufacturing tolerances, temperature variations or wear. Another alternative that might be used is a lash adjuster combined with the roller follower 60 to reduce wear, if needed. Still another alternative would be to make the closing rocker arm 59 compliant and flex it with a preload on installation. The preloaded and would then take up lash in the system without need for a hydraulic lash adjuster.

It should be apparent that the mechanisms illustrated, and many of their features, could take various forms as applied to other engine applications. For example, a single VVT mechanism could be applied to each finger follower or to direct acting followers of an engine, so that the valves could be actuated differently. Alternatively, dual actuators could be installed in a single bank of valves that could allow separate inlet valve control between two inlet valves of each cylinder. In another alternative, one actuator per bank of valves could be applied, but different profiles on the individual oscillating cams of each cylinder could allow one valve to have a smaller maximum lift than the other, so that the valve timing between the two valves could be changed as desired. Such an arrangement would enable low speed charge swirl while still maintaining a single computer controlled actuator. If desired, the mechanism of the invention could also be applied to the actuation of engine exhaust valves or other appropriate applications. In yet another alternative, the hydraulic lash adjuster may be placed between a finger attached to the opening cam follower and the separate return cam follower. In this case, the separate return cam follower has a sliding pad follower in contact with the closing cam.

It is also envisioned that a mechanical lash adjuster may replace the hydraulic lash adjuster. A mechanical lash adjuster approach would reduce zero lift friction because there would be less cam/follower contact force. In addition, a hydraulic lash adjuster requires a pressurized oil source as well as attention to orientation which could be eliminated with a mechanical lash adjuster.

The mechanical lash adjuster may be comprised of a set screw with a lock nut placed in the opening cam follower, such that it acts against the closing cam follower in a similar manner as the hydraulic lash adjuster. An alternative mechanical lash adjuster could be a replaceable adjustment shim placed in a retaining pocket between the opening, and closing cam followers. One skilled in the art will readily recognize that a mechanical lash adjuster requires careful cam design and manufacture so that valve train noise remains acceptable. Constant velocity ramps built into the return cam may be required to implement a mechanical lash adjuster. These ramps may be placed in the cam where contact is transferred from the opening cam to the closing cam.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. Valve actuating mechanism comprising:

opening and closing rotary cams rotatable together about a primary axis;

a control member pivotable about said primary axis and including a first pivot axis spaced from said primary axis;

a rocker connected with said control member and pivotable about said first pivot axis, said rocker having first and second an is extending from said first pivot axis to separate distal ends, an opening, cam follower operatively connected intermediate said distal end of the first arm and the first pivot axis, said opening cam follower operatively engaging said opening rotary cam, and a closing cam follower at said distal end of the second arm and operatively engaging said closing rotary cam, said opening and closing cam followers positively oscillating said rocker about the first pivot axis without requiring return spring means; and a pair of actuating levers each having one end pivotable about said primary axis, said one ends including oscillating cams engaging separate valve actuating members for actuating dual valves and having base circle portions and valve lift portions, the actuating levers having distal ends operatively connected with the distal end of said rocker first arm;

said control member being movable between a first angular position wherein primarily the valve lift portions of said oscillating cams engage their respective valve actuating members for fully opening and closing said valves and a second angular position wherein primarily the base circle portions of said oscillating cams engage the valve actuating members for providing minimal opening and closing movement of said valves.

2. Valve actuating mechanism as in claim 1 wherein the operative connection of the rocker and the actuating levers is through a link connected between distal ends of said rocker first arm and said levers.

3. Valve actuating mechanism as in claim 1 including a control lever pivotable about a secondary axis and connected to the control member through a slide and slot connection arranged such that angular motion of the control lever relative to the control member has a relatively higher angular ratio in a low valve lift range than in an intermediate valve lift range.

4. Valve actuating mechanism as in claim 3 wherein said angular ratio has a maximum ratio more than twice the minimum ratio.

5. Valve actuating mechanism as in claim 3 wherein a slot is formed in the control member and a slide includes a pin on the control lever and operatively engaging the slot, the slot being angled from a radial direction to provide the higher angular ratio in the low valve lift range.

6. Valve actuating mechanism as in claim 5 including a flat sided bushing on the pin and slidably engaging the slot.

7. Valve actuating mechanism as in claim 1 including a control shaft operatively engaging the control member for pivotal movement between said first and second angular positions; and a control shaft actuator operatively connected to selectively provide powered rotation of the control shaft, said actuator including means for preventing rotation of the control shaft opposite a direction of selected powered rotation.

8. Valve actuating mechanism as in claim 7 wherein the control shaft actuator is a worm drive having worm tooth angles selected to prevent back driving of the actuator from mechanism forces applied against the control shaft.

9. Valve actuating mechanism as in claim 1 wherein said valve actuating members are finger followers.

10. Valve actuating mechanism as in claim 1 wherein said opening cam follower is a roller.

11. Valve actuating mechanism as in claim 1 wherein said closing cam follower includes a lash adjuster.

12. Valve actuating mechanism comprising:

opening and closing rotary cams rotatable together about a primary axis;

a control member pivotable about said primary axis and including a first pivot axis spaced from said primary axis;

a rocker connected with said control member and pivotable about said first pivot axis, said rocker having first and second arms extending from said first pivot axis to separate distal ends, an opening cam follower operatively connected intermediate said distal end of the first arm and the first pivot axis, said opening cam follower operatively engaging said opening rotary cam, and a closing cam follower at said distal end of the second arm and operatively engaging said closing rotary cam, said opening and closing cam followers positively oscillating said rocker about the first pivot axis without requiring return spring means; and an actuating lever having one end pivotable about said primary axis, said one end including an oscillating cam engaging a valve actuating member for actuating an associated valve and having a base circle portion and a valve lift portion, the actuating lever having a distal end operatively connected with the distal end of said rocker first arm;

said control member being movable between a first angular position wherein the valve lift portion and the base circle portion of said oscillating cam alternately engage said valve actuating member for fully opening and closing said valve and a second angular position wherein primarily the base circle portion of said oscillating cam engages the valve actuating member for providing minimal opening and closing movement of said valve.

13. Valve actuating mechanism as in claim 12 wherein the operative connection of the rocker and the actuating lever is through a link connected between distal ends of said rocker first arm and said lever.

14. Valve actuating mechanism as in claim 12 including a control lever pivotable about a secondary axis and connected to the control member through a slide and slot connection arranged such that angular motion of the control lever relative to the control member has a relatively higher angular ratio in a low valve lift range than in an intermediate valve lift range, wherein a slot is formed in the control member and a slide includes a pin on the control lever and operatively engaging the slot, the slot being angled from a radial direction to provide the higher angular ratio in the low valve lift range.

15. Valve actuating mechanism as in claim 12 including a control shaft operatively engaging the control member for pivotal movement between said first and second angular positions; and a control shaft actuator operatively connected to selectively provide powered rotation of the control shaft, said actuator including means for preventing rotation of the control shaft opposite a direction of selected powered rotation.

* * * * *